US010700428B2

(12) United States Patent
Packer et al.

(10) Patent No.: US 10,700,428 B2
(45) Date of Patent: Jun. 30, 2020

(54) DUAL BAND OCTAFILAR ANTENNA

(71) Applicant: Harris Solutions NY, Inc., Rochester, NY (US)

(72) Inventors: Malcolm J. Packer, Fairport, NY (US); Joseph D. Majkowski, Pittsford, NY (US)

(73) Assignee: HARRIS SOLUTIONS NY, INC., Rochester, NY (US)

( * ) Notice: Subject to any disclaimer, the term of this patent is extended or adjusted under 35 U.S.C. 154(b) by 182 days.

(21) Appl. No.: 15/890,061

(22) Filed: Feb. 6, 2018

(65) Prior Publication Data

US 2019/0245268 A1 Aug. 8, 2019

(51) Int. Cl.

| | |
|---|---|
| ***H01Q 5/30*** | (2015.01) |
| ***H01Q 11/08*** | (2006.01) |
| ***H01Q 25/00*** | (2006.01) |
| ***H01Q 5/40*** | (2015.01) |
| ***H01Q 1/36*** | (2006.01) |
| ***H01Q 5/50*** | (2015.01) |
| ***H01Q 7/00*** | (2006.01) |

(52) U.S. Cl.

CPC ..... *H01Q 5/30* (2015.01); *H01Q 1/362* (2013.01); *H01Q 5/40* (2015.01); *H01Q 5/50* (2015.01); *H01Q 7/00* (2013.01); *H01Q 11/08* (2013.01); *H01Q 25/00* (2013.01)

(58) Field of Classification Search

CPC .. H01Q 5/30; H01Q 5/40; H01Q 5/50; H01Q 1/362; H01Q 25/00

See application file for complete search history.

(56) References Cited

U.S. PATENT DOCUMENTS

| | | | | |
|---|---|---|---|---|
| 4,008,479 A * | 2/1977 | Smith | H01Q 1/362 343/895 |
| 5,255,005 A | 10/1993 | Terret et al. | |
| 5,450,093 A | 9/1995 | Kim | |
| 5,828,348 A | 10/1998 | Tassoudji et al. | |
| 5,909,196 A * | 6/1999 | O'Neill, Jr. | H01Q 1/242 343/853 |

(Continued)

FOREIGN PATENT DOCUMENTS

| | | |
|---|---|---|
| CN | 201226373 Y | 4/2009 |
| EP | 0877442 A2 | 11/1998 |
| WO | 98/28817 A1 | 7/1998 |

OTHER PUBLICATIONS

Extended European Search Report dated Jun. 26, 2019, Application Serial No. EP19153719.0 in the name of Harris Solutions NY, Inc.

*Primary Examiner* — Dameon E Levi
*Assistant Examiner* — Jennifer F Hu
(74) *Attorney, Agent, or Firm* — Fox Rothschild LLP; Robert J. Sacco; Carol E. Thorstad-Forsyth

(57) ABSTRACT

Antenna system includes first and second quadrifilar radiating elements. A first one of the quadrifilar radiating elements (QRE) is comprised of a plurality of first bifilar helical loops (BHLs). The BHLs are oriented in a mutual orthogonal relationship on a common axis. A second QRE shares a common feed structure with the first QRE. The second QRE comprises a plurality of second BHLs oriented in a mutual orthogonal relationship on the common axis. The first QRE is tuned for operation in a first frequency band, the second QRE is tuned for operation in a second frequency band different from the first frequency band.

23 Claims, 5 Drawing Sheets

(56) References Cited

U.S. PATENT DOCUMENTS

| | | | | |
|---|---|---|---|---|
| 5,986,620 | A | 11/1999 | Filipovic et al. | |
| 6,184,844 | B1 | 2/2001 | Filipovic et al. | |
| 6,300,917 | B1 | 10/2001 | Leisten et al. | |
| 6,653,987 | B1 | 11/2003 | Lamensdorf et al. | |
| 9,502,767 | B2 * | 11/2016 | Stepanenko | H01Q 11/08 |
| 10,483,631 | B2 * | 11/2019 | McMichael | H01Q 1/362 |
| 2008/0174501 | A1 | 7/2008 | Licul et al. | |
| 2011/0001684 | A1 | 1/2011 | Haarakangas | |
| 2011/0254755 | A1 | 10/2011 | DiNallo | |
| 2014/0159983 | A1 * | 6/2014 | Leisten | H01Q 5/371<br>343/843 |

* cited by examiner

DUAL BAND OCTAFILAR ANTENNA

BACKGROUND OF THE INVENTION

Statement of the Technical Field

The inventive arrangements relate to radio frequency communication systems and more particularly to dual band antennas which are used in radio frequency communication systems.

Description of the Related Art

Circular polarization is often employed in systems for communicating with earth orbiting satellites and long-range airborne vehicles. Circularly polarized systems are advantageous in these applications because they are resistant to multipath effects, and resist the effects of fading caused by mismatched polarizations due to aircraft pitch and roll. Quadrifilar helix antennas (QHAs) are known in the art to be well suited for these types of communications systems because they are circularly polarized and can provide positive gain for any visible satellite location.

The basic design of a QHA is well known. The antenna consists of two bifilar helical loops, each consisting of two legs. These loops are oriented in a mutual orthogonal relationship on a common axis. Each of the four legs of this antenna is fed a signal 90 degrees apart in phase (i.e., in phase quadrature). One of the commonly accepted advantages of such antennas is that they generally do not require a conventional ground plane.

SUMMARY OF THE INVENTION

This disclosure concerns an antenna system which includes first and second quadrifilar radiating elements. A first one of the quadrifilar radiating elements (QRE) is comprised of a plurality of first bifilar helical loops (BHLs). The BHLs are oriented in a mutual orthogonal relationship on a common axis. Each first BHL comprises pair of elongated conductive legs which define a plurality of turns about the common axis at a first pitch angle and having a first turn radius. A second QRE shares a common feed structure with the first QRE. The second QRE comprises a plurality of second BHLs oriented in a mutual orthogonal relationship on the common axis. Each second BHL comprises a pair of elongated conductive legs which define a plurality of turns about the common axis at a second pitch angle and has a second turn radius. The first QRE is tuned for operation in a first frequency band, the second QRE is tuned for operation in a second frequency band different from the first frequency band, and the first radius is substantially the same as the second radius.

According to one aspect, the first frequency band has a first frequency range including a first band upper frequency limit, and the second frequency band has a second frequency range including a second band lower frequency limit. A percent difference between the second band lower frequency limit and the first band upper frequency limit is less than 15%.

According to another aspect a first helical length of each elongated conductive leg comprising each of the first BHLs is longer than a second helical length of each elongated conductive leg comprising each of the second BHLs.

In some scenarios disclosed herein, the first pitch angle is different from the second pitch angle. For example each of the first pitch angle and the second pitch angle can be selected to be between 55° and 68°, and a difference between the first pitch angle and the second pitch angle is between 1° and 6°. Further, the first pitch angle can be advantageously selected to be greater than the second pitch angle.

According to a further aspect, the pair of elongated conductive legs comprising each of the first BHLs, and the pair of elongated conductive legs comprising each of the second BHLs will all occupy the same surface circumference around said common axis. The surface circumference in such scenarios can be defined by a cylindrical dielectric form which is axially aligned with the common axis.

The common feed structure for the antenna system is disposed in a feed plane. The common feed structure can be disposed transverse to the common axis, and each pair of elongated conductive legs comprising the first BHL extend a first distance in a predetermined direction along the common axis from the feed plane to a first terminal end plane. Each of the first BHLs includes a transverse conductor portion which extends between each pair of elongated conductive legs in the first terminal end plane. The transverse conductor portions from the first BHLs intersect in the first terminal end plane to form an electrical connection.

Further, each pair of elongated conductive legs comprising each of the second BHLs extends in the predetermined direction a second distance along the common axis, to a second terminal end plane. The second distance can be chosen to be less than the first distance. Each of the second BHLs includes a transverse conductor portion which extends between each pair of elongated conductive legs in the second terminal end plane According to one aspect, a first intersection point of the transverse conductor portions comprising each said first BHL can be axially aligned on said common axis with a second intersection point of the transverse conductor portions comprising each said second BHL. In such scenarios, the transverse conductor portions comprising each said second BHL are advantageously electrically isolated from each other at the second intersection point.

The disclosure also concerns a method for providing a dual-band antenna system. The method facilitates radio frequency operations in a first frequency band using a first quadrifilar radiating element (QRE). The first QRE comprises a plurality of first bifilar helical loops (BHLs) oriented in a mutual orthogonal relationship on a common axis as described above. Accordingly, each first BHL includes a pair of elongated conductive legs which define a plurality of turns about said common axis at a first pitch angle and having a first turn radius. In order to facilitate radio frequency operations in a second frequency band different from the first frequency band, a second QRE is provided. The second QRE shares a common feed structure with the first QRE. The method involves arranging the second QRE to include a plurality of second BHLs oriented in a mutual orthogonal relationship on the common axis. Each second BHL comprises a pair of elongated conductive legs which define a plurality of turns about the common axis at a second pitch angle and having a second turn radius. The method also involves arranging a configuration of the first and second QRE so that the first radius is substantially equal to the second radius, whereby the elongated conductive legs comprising the first QRE can be disposed on a same cylindrical shell as the elongated conductive legs comprising the second QRE.

BRIEF DESCRIPTION OF THE DRAWINGS

Embodiments will be described with reference to the following drawing figures, in which like numerals represent like items throughout the figures, and in which.

DETAILED DESCRIPTION

Figure 1:
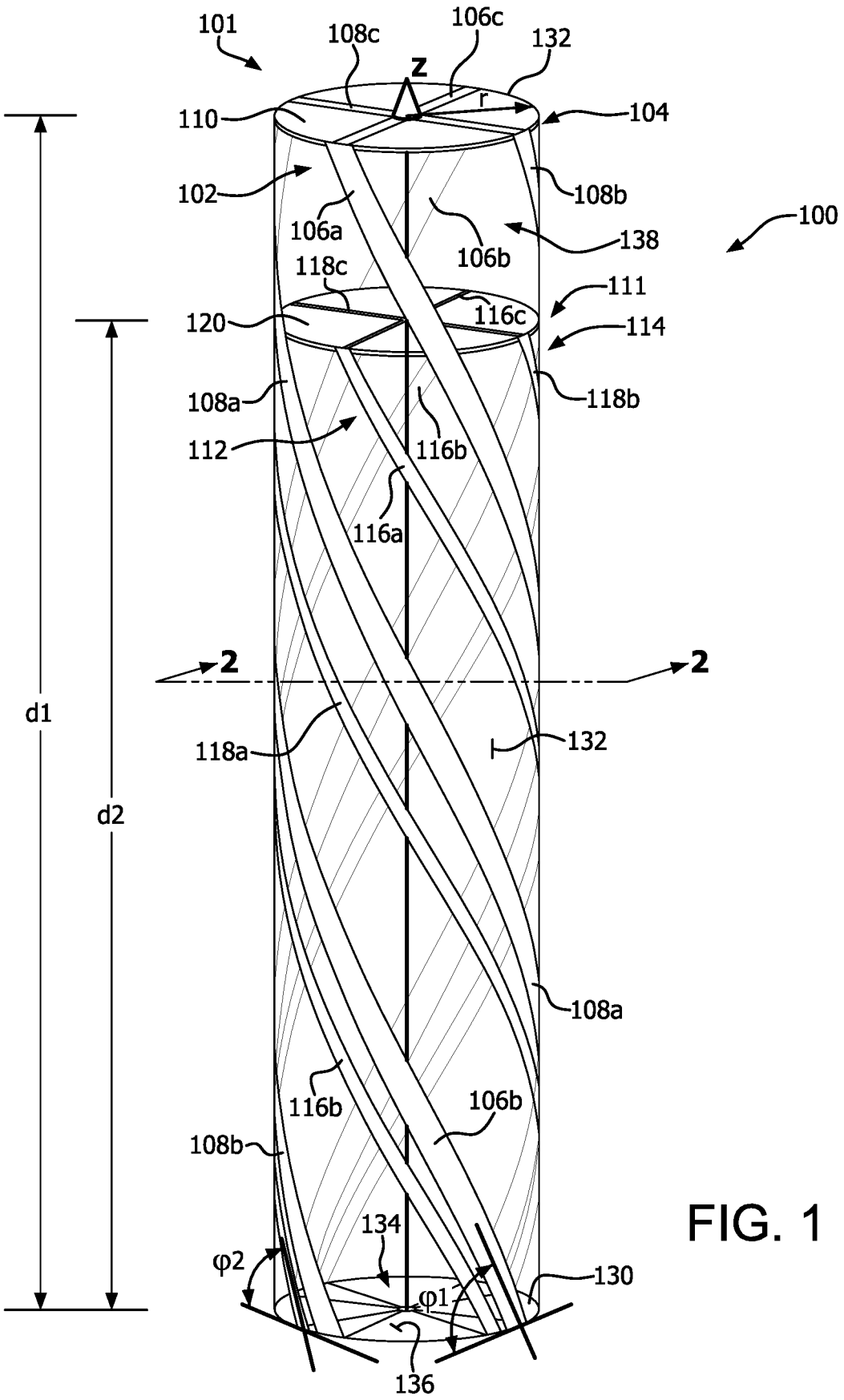
FIG. 1 is a drawing of a dual band octafilar antenna system that is useful for understanding certain aspects of this disclosure.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

Satellite communication (SATCOM) systems offer many advantages. For example, these systems can facilitate high bit rates and operational communications to warfighters in the field. Newer systems also facilitate improved operational availability through the use of small mobile and man-portable terminals. But SATCOM terminals still require antenna systems to support the communication link with earth orbiting satellites and these antennas present many design challenges.

Helical antennas are known in the art to be well suited for SATCOM systems because they facilitate circularly polarized radiation and can provide positive gain for any visible satellite location. But these SATCOM/helical antennas are in many respects not well suited for mobile or man-portable operations. They tend to be large, and/or have a poor form factor—especially for dismounted operations. Also, their complex design can often make them relatively expensive to manufacture. A further design challenge associated with such antennas is the somewhat limited bandwidth that can be achieved with a single antenna structure.

The Mobile User Objective System (MUOS) is an ultra-high frequency (UHF) SATCOM system which is currently in use by the United States Department of Defense (DoD). In the MUOS system, a UHF uplink band is defined at 300-320 MHz, and a downlink band is defined at 360-380 MHz. Accordingly, there is less than 12.5% difference in frequency at the band edge between the two separate bands. This band plan arrangement places additional demands on the antenna design since the two bands are relatively closely spaced in frequency, but far enough apart so as to require separate antenna elements for achieving desired gain characteristics. This close separation of the two bands creates challenges when trying to create a small form factor antenna that is suitable for man-portable operations.

Accordingly, there is disclosed herein a dual band, circularly polarized antenna system which is based on the quadrifilar helix antenna (QHA) concept. The disclosed antenna facilitates operations in two nearby UHF frequency bands (e.g., antenna bands which are less than 12.5% different in frequency), while maintaining a lightweight, small volume form factor. More particularly, the dual band arrangement is comprised of a plurality of QHA elements which have substantially the same helical radius. The QHA elements are sometimes referred to herein as quadrifilar radiating elements (QREs) to emphasize that they are not really separate antennas but instead comprise elements which together form part of a single antenna system.

The QREs of the antenna system will advantageously include a shared feed structure. In some scenarios, the plurality of nested QREs can comprise two QRE elements which occupy the same surface circumference. The resulting system facilitates good circularly polarized gain at low elevation angles in each of two closely spaced frequency bands. The system is also less complex to manufacture as compared to conventional antenna systems and offers improved performance. A further advantage of the system is that it solves a safety problem associated with portable antennas that protrude above a user's head, where there is the potential of accidental contact with high voltage sources. These and other features of the antenna system are described below in greater detail.

Shown in FIG. 1 is a drawing that is useful for understanding certain aspects of an antenna system disclosed herein. The antenna system 100 includes a first quadrifilar radiating element 101 and a second QRE 111. In some scenarios disclosed herein, the arrangement of each QRE 101, 111 can be generally consistent with a QHA type of antenna, except that the two QREs share a common feed structure 134.

QRE 101 is comprised of a plurality of first bifilar helical loops (BHLs) 102, 104 which extend along a common z axis. More particularly, the plurality of first BHLs can extend along the z axis from a feed plane 130 to a first terminal end plane 110, which is located a first distance d1 from the feed plane. In some scenarios, the terminal end plane 110 and the feed plane 130 can be orthogonal to the common axis z as shown. In some scenarios the plurality of first BHLs can consist of two first BHLs 102, 104 as shown.

Each first BHL 102, 104 is comprised of a pair of elongated conductive legs which define a plurality of turns about said common axis at a first pitch angle φ1. In the first BHL 102, these elongated conductive legs are labeled as 106*a*, 106*b*. In the first BHL 104, these elongated conductive legs are labeled as 108*a*, 108*b*. The first BHLs 102, 104 that together form the first QRE 101 are advantageously oriented in a mutual orthogonal relationship with respect to one another. The orthogonality as between the first BHLs 102, 104 is best seen at first terminal end plane 110 where transverse conductor portions 106*c*, 108*c* (which respectively form a part of each first BHL 102, 104) intersect at approximately 90°. An intersection point of the transverse conductor portions 106*c*, 108*c* can in some scenarios be aligned with the common axis z.

The second QRE 111 is comprised of a plurality of second BHLs 112, 114 which also extend along the common z axis. More particularly, the plurality of second BHLs 112, 114 can extend along the z axis from the feed plane 130 to the second terminal end plane 120, which is located a second distance d2 from the feed plane. In a scenario shown in FIG. 1, the plurality of second BHLs consist of two BHLs 112, 114.

Referring once again to FIG. 1, it may be observed that the plurality of second BHLs 112, 114 are oriented in a mutual orthogonal relationship on the common axis z. Each second BHL 112, 114 is comprised of a pair of elongated conductive legs which define a plurality of turns about the common axis at a second pitch angle φ2. In second BHL 112, these elongated conductive legs are labeled as 116*a*, 116*b*. In second BHL 114 these elongated conductive legs are labeled as 118*a*, 118*b*. The orthogonality between the second BHLs 112, 114 is best seen at second terminal end plane 120 where transverse conductor portions 116*c*, 118*c* (which respectively form part of each second BHL 112, 114) intersect at approximately 90°. An intersection point of the transverse conductor portions 116*c*, 118*c* can in some scenarios be aligned with the common axis z.

It can be observed in FIG. 1 that elongated conductive legs 108*a*, 108*b* are circumferentially offset with respect to elongated conductive legs 118*a*, 118*b*. Similarly, Elongated conductive legs 106*a*, 106*b* are circumferentially offset with respect to elongated conductive legs 116*a*, 116*b*. The circumferential offset at the feed plane 130 for elongated conductive leg 108*b* as compared to 118*b* is referenced in FIG. 2 as the angle α. Although not expressly shown in the drawing, a similar offset is provided as between 108*a*-118*a*, 106*a*-116*a*, and 106*b*-116*b*. An acceptable range for angle α can be between 10° to 20°. However, it may be noted that that elongated conductive leg 108*b* diverges from 118*b* with increasing distance from the feed plane 130 so this circumferential offset will vary with distance from the feed plane.

In some scenarios, the values of d1, d2, α and φ1, φ2 are advantageously selected so that the transverse conductor portions 116*c*, 118*c* of the second BHLs are respectively aligned with the transverse conductor portions 106*c*, 108*c* of the first BHLs. Stated differently, the transverse conductor portion 116*c* can be disposed in a first alignment plane which passes through the common axis and also passes through transverse conductor portion 106*c*. Similarly, transverse conductor portion 118*c* can be disposed in a second alignment plane which passes through the common axis and also passes through transverse conductor portion 108*c*.

Figure 8:
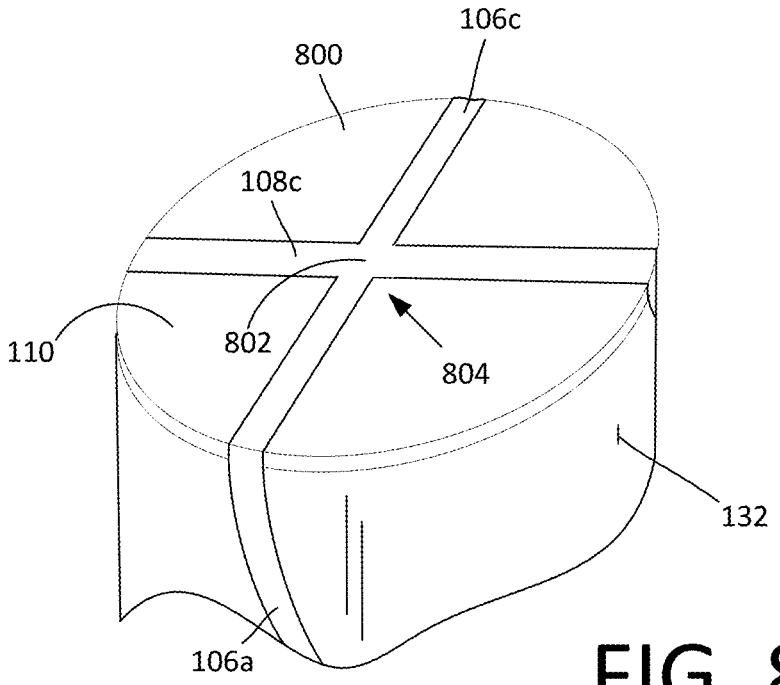
FIG. 8 is an enlarged view of a first terminal end plane of the antenna in FIG. 1.
Figure 9:
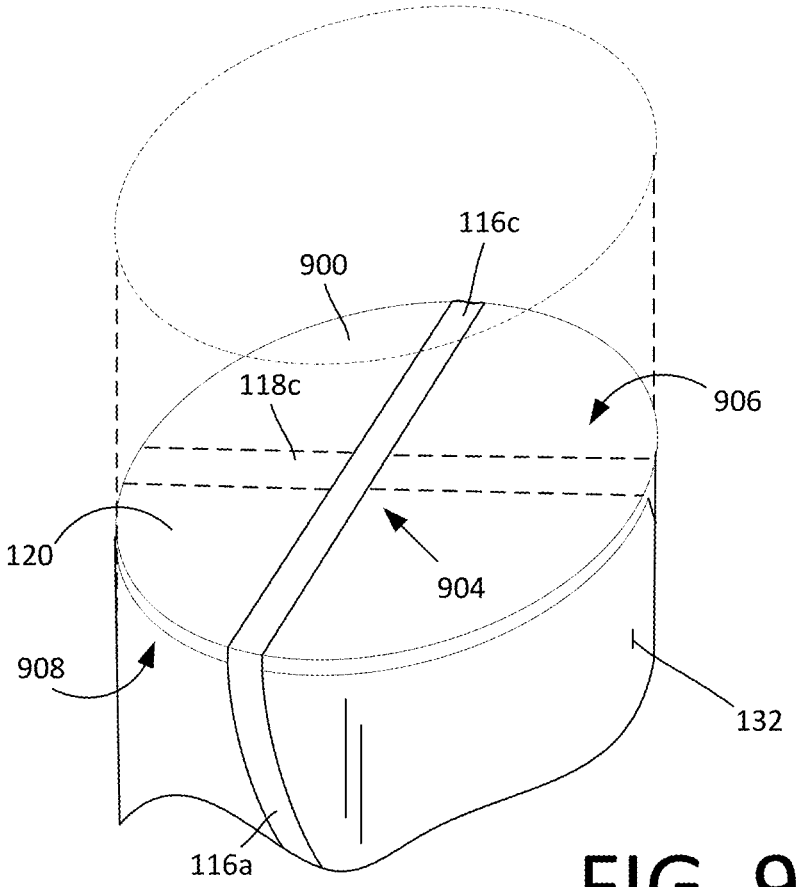
FIG. 9 is an enlarged view of the second terminal end plane of the antenna in FIG. 1.

The transverse conductor portions 106*c*, 108*c* which comprise portions of the of first BHLs 102, 104, can be electrically connected at their point of intersection in the first terminal end plane 110. Such an arrangement is illustrated in FIG. 8 which shows a more detailed view of this electrical connection 802 at the point of intersection 804 in the first terminal end plane 110. In the example shown, the transverse conductor portions are shown disposed on a dielectric substrate 800. In a similar way, the transverse conductor portions 116*c*, 118*c* which comprise portions of the second BHLs 112, 114 can be electrically connected at their point of intersection in the second terminal end plane 120. The electrical connection in each case can be a direct electrical connection involving a direct conduction path between the transverse conductor portions at their point of intersection. But in some scenarios it has been determined that a direct electrical connection of transverse conductor portions 116*c*, 118*c* can have a negative effect upon the antenna performance whereby a discontinuity can be introduced in the antenna gain pattern and impedance at certain frequencies. This problem is overcome as shown in FIG. 9 by electrically isolating the transverse conductor portions 116*c*, 118*c* at their point of intersection in the second terminal end plane 120. In the example shown, such electrical isolation can be achieved by disposing transverse conductor portion 116*c* on a first side 906 of a dielectric substrate 900, and disposing transverse conductor portion 118*c* on an opposing second side 908 of the dielectric substrate.

Figure 2:
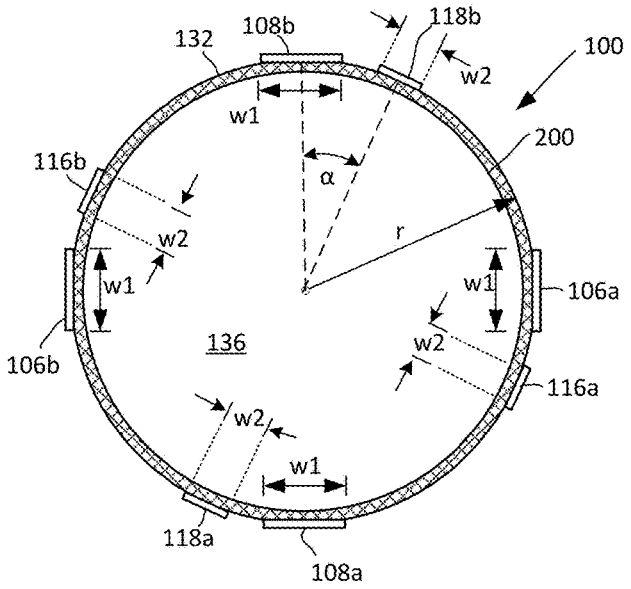
FIG. 2 is a cross-sectional view of the antenna in FIG. 1, taken along line 2-2.

According to one aspect, a line width of each elongated conductive leg used to form QRE 101 can be different as compared to the line thickness of the elongated conductive legs used to form QRE 111. This concept is illustrated in FIG. 2 which shows that a line width of the elongated conductive legs 106*a*, 106*b*, 108*a*, 108*b* can be a first width w1, whereas a line width of the elongated conductive legs 116*a*, 116*b*, 118*a*, 118*b* can be a second line width w2. In a scenario illustrated in FIG. 1, the line width w1 is greater than line width w2. In some scenarios the line width of transverse conductor portions 106*c*, 108*c* can correspond to w1 and the line widths of transverse conductor portions 116*c*, 118*c* can correspond to w2. However, the invention is not limited in this regard and in some embodiments the line width of the transverse conductor portions can be different as compared to the width of the elongated conductive legs.

Referring now to FIGS. 1 and 2, it can be observed that the exterior surface circumference 132 is a cylindrical shape which can be defined by radius r and distance d1, where r corresponds to the helical radius of the conductive legs around the common axis z. Surface circumference 132 in such scenarios can be established by a cylindrical dielectric form or shell 200 that is axially aligned with the common axis z. The terminal end planes 110, 120 can be planar elements similarly formed of a dielectric substrate material. The dielectric substrate material used to define the terminal end planes can be of the same or a different type as compared to the material forming the cylindrical dielectric shell 200.

The interior 136 of the cylindrical dielectric form can be comprised of the same material as the cylindrical dielectric shell or it can be filled with a different type of dielectric material. Embodiments are not limited in this regard and the dielectric material disposed in the interior 136 can be any type of low loss dielectric material such as air or a dielectric foam. Similarly, the interior 138 of the cylindrical dielectric form between the first terminal end plane 110 and the second terminal end plane 120 can be comprised of the same material as the dielectric shell 200 or it can be filled with a different type of dielectric material. A low loss dielectric material such as air or a dielectric foam can be disposed in this space.

The elongated conductive legs 106*a*, 106*b*, 108*a*, 108*b*, and 116*a*, 116*b*, 118*a*, 118*b* can be disposed directly on the surface circumference of the cylindrical dielectric shell 200. In some scenarios, the pair of elongated conductive legs 106*a*, 106*b*, 108*a*, 108*b* comprising the first BHLs, and the pairs of elongated conductive legs 116*a*, 116*b*, 118*a*, 118*b* comprising the second BHLs will all occupy the same surface circumference 132. In a scenario shown in FIGS. 1 and 2, this is accomplished by disposing all the elongated conductive legs 106*a*, 106*b*, 108*a*, 108*b*, 116*a*, 116*b*, 118*a*, 118*b* on the same exterior surface circumference 132 of the cylindrical dielectric shell 200.

Figure 3:
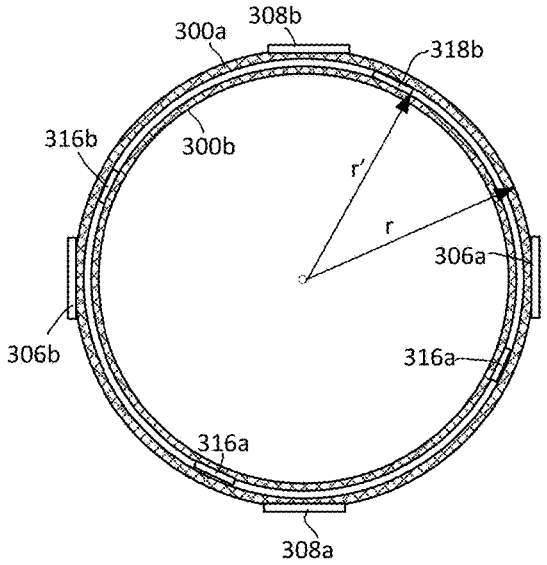
FIG. 3 is a drawing that is useful for understanding a first alternative embodiment in which a first quadrifilar radiating element has substantially the same radius as a second quadrifilar radiating element.

Still, it will be appreciated that in other scenarios a similar result can be obtained using slightly different techniques. For example in a scenario shown in FIG. 3 a relatively thin layer of dielectric material is used to form pair of coaxial dielectric shells 300*a*, 300*b*. In FIG. 3, the conductive legs (e.g. conductive legs 306*a*, 306*b*, 308*a*, 308*b*) forming the first BHLs can be disposed on an outer surface of a dielectric shell 300*a*, and the conductive legs (e.g. conductive legs 316*a*, 316*b*, 318*a*, 318*b*) forming the second BHLs can be disposed on an outer surface of an inner dielectric shell 300*b*. A third alternative is shown in FIG. 4 where conductive legs 406*a*, 406*b*, 408*a*, 408*b* of the first BHLs are formed on the outer surface of the dielectric shell 400, and conductive legs 416*a*, 416*b*, 418*a*, 418*b* of the second BHLs are formed on the inner surface of the same dielectric shell.

Figure 4:
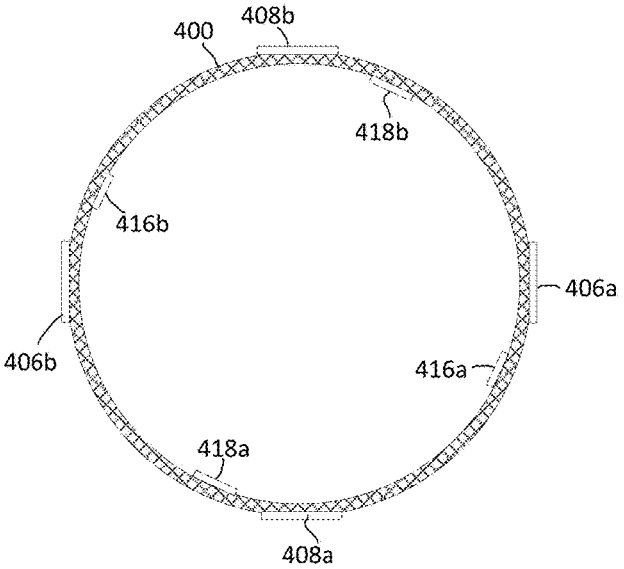
FIG. 4 is a drawing that is useful for understanding a second alternative embodiment in which a first quadrifilar radiating element has substantially the same radius as a second quadrifilar radiating element.

It can be observed in FIG. 2 that a first QRE and a second QRE will each define an identical radius r, whereas in FIGS. 3 and 4 the first and second QRE will have slightly different helix radii r, r' which differ only in accordance with a thickness of dielectric shell 300*a* or 400. Still, in each case the BHLs 102, 104 which form the first QRE 101 can be understood to define a radius r which is substantially the same as the BHLs 112, 114 which form the second QRE 111. Accordingly, for purposes of this disclosure the radius of a first QRE and a second QRE can be understood to be substantially the same if the difference between their respective radii is less than about 5%.

It can be observed in FIG. 1 that a first helical length of each elongated conductive leg comprising each of the first BHLs 102, 104 can be different as compared to a second helical length of each elongated conductive leg comprising each of the second BHLs 112, 114. For example, in the scenario shown in FIG. 1 the first helical length of each elongated conductive leg 106*a*, 106*b*, 108*a*, 108*b* is longer as compared to the second helical length of elongated conductive leg 116*a*, 116*b*, 118*a*, 118*b*. As will be appreciated by those skilled in the art, each of these helical lengths can be calculated based on the radius r of the helix defined by each leg, the pitch angle, and the specified length (d1 or d2) of the helix.

The term pitch angle as used herein refers to the angle between an elongated conductive leg 106*a*, 106*b*, 108*a*, 108*b* 116*a*, 116*b*, 118*a*, 118*b* and a plane of rotation that is orthogonal to the Z axis in FIG. 1. The first pitch angle φ1 and the second pitch angle φ2 are shown in FIG. 1 with respect to a plane of rotation 136 about the z axis.

In some scenarios, the first pitch angle φ1 is equal to the second pitch angle φ2. However, choosing the first pitch angle to be the same as the second pitch angle can lead to an unwanted increase in the coupling as between the first QRE 101 and the second QRE 111. In this regard it has been determined that a reduction in coupling can be obtained if the first pitch angle φ1 used for the legs of the first QRE 101 is different from the second pitch angle φ2 that is applied to the legs of the second QRE. For example, in a scenario shown in FIG. 1 the first pitch angle φ1 is advantageously selected to be greater than the second pitch angle φ2.

Figure 5:
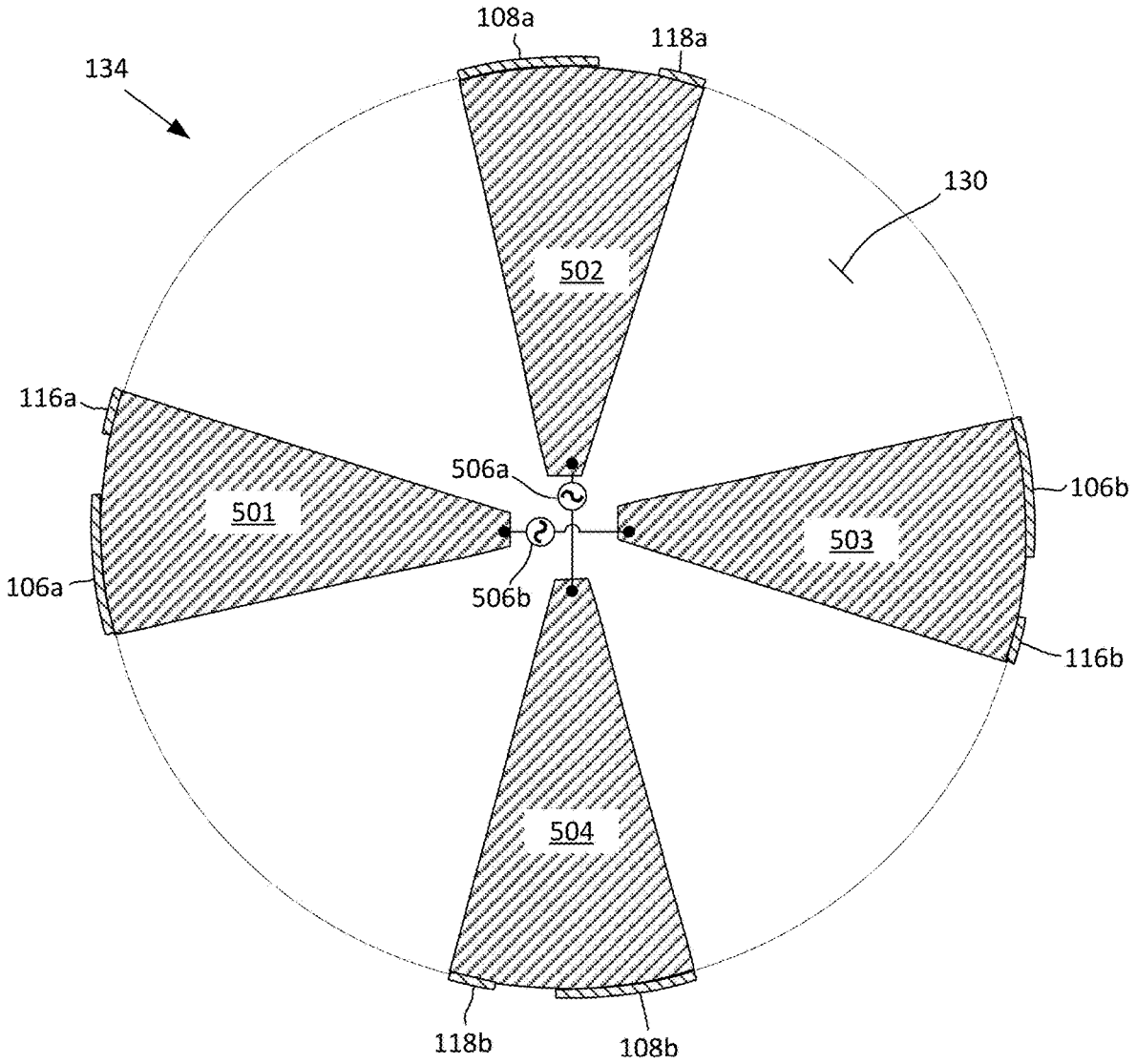
FIG. 5 is a drawing that is useful for understanding an antenna feed used in the antenna system of FIG. 1.

An example of a feed structure 134 is shown in greater detail in FIG. 5. The feed structure 134 is a balanced feed network that is comprised of four planar feed elements 501, 502, 503, 504. Each feed element is comprised of a highly conductive material, such as copper (Cu). The feed elements can be planar elements disposed on the feed plane 130, and each element can be tapered as shown to facilitate impedance matching to the antenna system. In a scenario shown in FIG. 5, each feed 501, 502, 503, 504 is electrically connected to a pair of the elongated conductive legs. For example, feed element 501 is connected to elongated conductive legs 106*a*, 116*a*. Feed element 502 is electrically connected to elongated conductive legs 108*a*, 118*a*. Feed element 503 is electrically connected to elongated conductive legs 106*b*, 116*b*. Feed element 504 is electrically connected to elongated conductive legs 108*b*, 118*b*. RF signals sources 506*a*, 506*b* can be used to drive the antenna systems.

Figure 6:
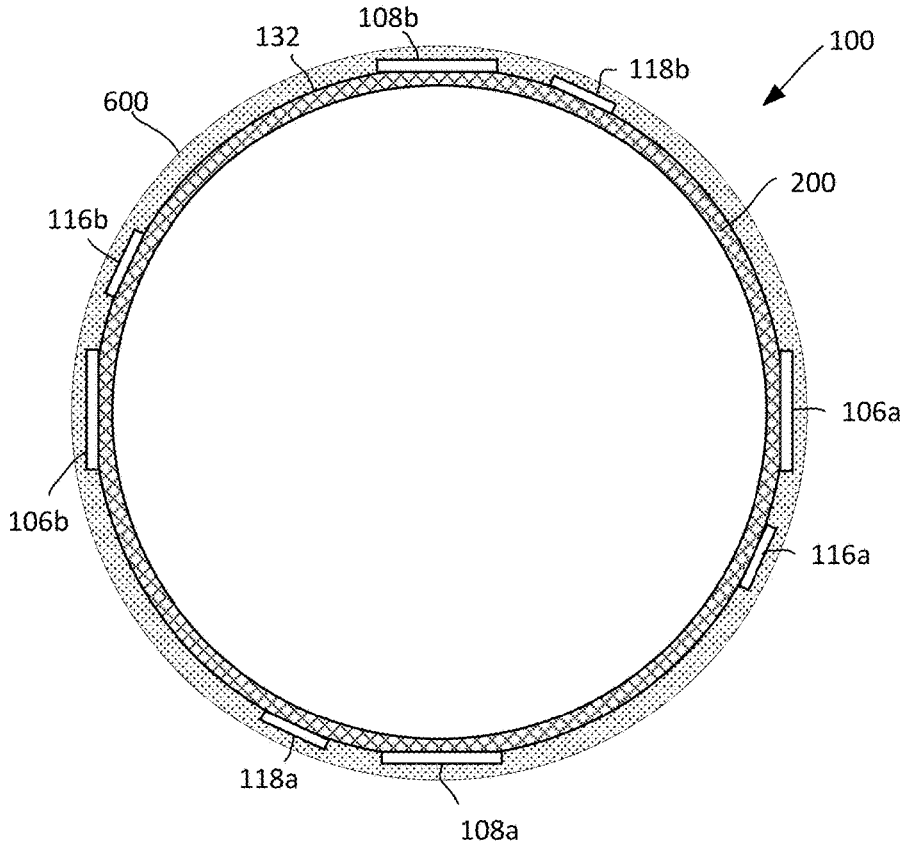
FIG. 6 is a drawing that is useful for understanding a dielectric cover which can be disposed on the antenna system in FIG. 1 for high voltage protection.
Figure 7:
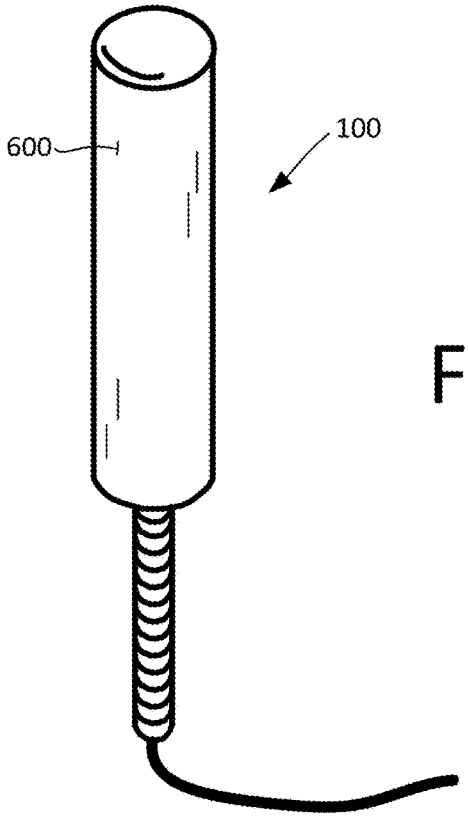
FIG. 7 is a perspective view of the antenna system in FIG. 6.

When used in a man-portable configuration the antenna system 100 can be mounted to a radio equipment pack or ruck as part of an integrated system. In such a scenario, QREs 101, 111 which form the antenna system 100, can present a potential electrical path between the user and low-hanging high voltage wires. Such a condition can be dangerous when the wearer is moving through environments that might include low or damaged electrical lines. To alleviate this risk, the exterior of the antenna 100 can be enclosed within a radome as shown in FIGS. 6 and 7. The dielectric radome 600 can serve to electrically insulate the conductive metal portions of QREs 101, 111 from the exterior environment while adding minimal weight and bulk to the antenna system. The dielectric radome 600 can be comprised of any suitable dielectric material that is low loss and sufficiently rugged to withstand interaction with tree branches and other obstructions in the environment. Examples of suitable materials that can be used for this purpose include FR4, fiberglass and G10, all of which are well-known in the art. As will be appreciated by those skilled in the art, the selection of dielectric materials will affect the electrical performance of the antenna system and must be taken into account during the design cycle.

The antenna system 100 can be optimized for various combinations of frequency bands. For example computer optimization routines can be used to determine optimal values of the helix radius r, r', the distances d1, d2, the pitch angle value assigned to φ1 and φ2, the line widths w1, w2, the dielectric material type and thickness chosen for the cylindrical dielectric form, and the dielectric fill material used within the interior 136 of the cylindrical dielectric form. For example, these computer optimization routines can evaluate factors such as antenna gain, impedance bandwidth, efficiency, radiation pattern, radiation gain, and polarization. Moreover, these and other design factors disclosed herein can be evaluated while constraining the radius of the QRE 101 and 111 so that the radii of these elements are equal or substantially the same. A further design consideration in such computer optimization can be a restriction of the radius value r to a value which is suitable for man-portable operations. For example, the magnitude of the radius value can be constrained to a maximum value which is deemed practical for attachment to a radio pack or ruck.

To facilitate a greater understanding of the disclosure herein, an example is provided of an antenna system that is suitable for MUOS SATCOM operations in which a UHF uplink band is defined at 300-320 MHz, and a downlink band is defined at 360-380 MHz. In this scenario, the first QRE 101 can be configured for operations in the 300-320 MHz range and the second QRE 111 is configured for operations in the 360-380 MHz band. In such an embodiment, a suitable antenna design would have the following characteristics:

Radius r=36 mm
Distance d1=330 mm
Distance d2=274 mm
Pitch angle φ1=63°
Pitch angle φ2=60°
Line width w1=4 mm
Line width w2=8 mm
Offset angle α=14°
Cylindrical form
  material type: Pyralux® flexible circuit material (commercially available from Dupont USA)
  material thickness: 4 mil
Terminal end plane/feed board
  material type: Rogers 4003
  material thickness: 31 mil
External Dielectric: G10

Dielectric fill material: dielectric foam

From the foregoing data, the actual length of each elongated conductive leg and the number of wraps around the cylindrical form can be easily determined using basic equations. In this instance a length of each elongated conductive leg 106*a*, 106*b*, 108*a*, 108*b* would be 370.4 mm, and the length of each elongated conductive leg 116*a*, 116*b*, 118*a*, 118*b* would be 316.4 mm. Further, each elongated conductive leg 106*a*, 106*b*, 108*a*, 108*b* would wrap around the cylindrical form a total of 0.743 times, and each elongated conductive leg 116*a*, 116*b*, 118*a*, 118*b* would wrap around the cylindrical form a total of 0.699 times.

In the example given herein, the pitch angle φ1=63° and the pitch angle φ2=60°. However, it should be noted that these are optimized values for the particular stated design and the disclosure is not intended to be limited in this regard. Accordingly, in the example described herein, it should be appreciated that the first pitch angle and the second pitch can be different from the values stated. For example, in some scenarios, the pitch angle for φ1 and φ2 can be chosen to have values in the range between 50° and 73°. In other scenarios, the pitch angle for φ1 and φ2 can be chosen to have values in the range between is between 55° and 68°. In still other scenarios, the pitch angle values can be in a range between 57° and 66°. Similarly, a difference A as between the pitch angle for φ1 and φ2 can be chosen to have a different value in the range of 0° to 6°. Finally, the optimized results in the example are such that φ1>φ2. However, embodiments are not limited in this regard and in some scenarios φ1 can be the same as or less than φ2.

Computer modeling has shown that variations in the various design parameters will result in significant changes in antenna performance. These changes will depend on the particular design parameter which is being modified but will generally vary in complex ways, particularly when more than one parameter is being varied. Moving the elongated legs closer together can result in improvements in low band impedance by moving the value closer to 50 ohms, but this improvement will tend to negatively affect the impedance performance of the high frequency band. Likewise, it has been determined that increasing the difference in pitch angle of φ1 as compared to φ2 can result in performance improvements of the high band element if the difference between the angles is small (e.g., less than about 4°). In particular, the difference in pitch angle can help improve the input impedance of the high band without substantially negatively affecting low band performance. Similar types of complex performance variations are found with variations in line width of the elements comprising the elongated conductive legs. Changes in pitch angles for φ1 and φ2 were found to produce complex changes in impedance, gain, and VSWR performance.

Reference throughout this specification to features, advantages, or similar language does not imply that all of the features and advantages that may be realized should be or are in any single embodiment. Rather, language referring to the features and advantages is understood to mean that a specific feature, advantage, or characteristic described in connection with an embodiment is included in at least one embodiment. Thus, discussions of the features and advantages, and similar language, throughout the specification may, but do not necessarily, refer to the same embodiment.

Furthermore, the described features, advantages and characteristics disclosed herein may be combined in any suitable manner in one or more embodiments. One skilled in the relevant art will recognize, in light of the description herein, that the embodiments can be practiced without one or more of the specific features or advantages of a particular embodiment. In other instances, additional features and advantages may be recognized in certain embodiments that may not be present in all embodiments.

Reference throughout this specification to "one embodiment", "an embodiment", or similar language means that a particular feature, structure, or characteristic described in connection with the indicated embodiment is included in at least one embodiment. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Although the embodiments have been illustrated and described with respect to one or more implementations, equivalent alterations and modifications will occur to others skilled in the art upon the reading and understanding of this specification and the annexed drawings. In addition, while a particular feature of an embodiment may have been disclosed with respect to only one of several implementations, such feature may be combined with one or more other features of the other implementations as may be desired and advantageous for any given or particular application. Thus, the breadth and scope of the embodiments disclosed herein should not be limited by any of the above described embodiments. Rather, the scope of the invention should be defined in accordance with the following claims and their equivalents.

We claim:

1. An antenna system, comprising:

a first quadrifilar radiating element (QRE) comprising a plurality of first bifilar helical loops (BHLs) oriented in a mutual orthogonal relationship on a common axis, each first BHL comprising a pair of first elongated conductive legs, each said first elongated conductive leg defining a plurality of turns about said common axis at a first pitch angle, having a first turn radius, and electrically connected to closed circuit terminations; and a second QRE sharing a common feed structure with the first QRE, the second QRE comprising a plurality of second BHLs oriented in a mutual orthogonal relationship on the common axis, each second BHL comprising a pair of second elongated conductive legs, each said second elongated conductive leg defining a plurality of turns about the common axis at a second pitch angle, having a second turn radius, and electrically connected to closed circuit terminations;

wherein the first QRE is tuned for operation in a first frequency band, the second QRE is tuned for operation in a second frequency band different from the first frequency band, and the first radius is substantially the same as the second radius; and wherein the first pitch angle is different than the second pitch angle.

2. The antenna system according to claim 1, wherein the first frequency band has a first frequency range including a first band upper frequency limit, the second frequency band has a second frequency range including a second band lower frequency limit, and wherein a percent difference between the second band lower frequency limit and the first band upper frequency limit is less than 15%.

3. The antenna system according to claim 1, wherein a first helical length of each first elongated conductive leg comprising each of the first BHLs is longer than a second helical length of each second elongated conductive leg comprising each of the second BHLs.

4. The antenna system according to claim 1, wherein each of the first pitch angle and the second pitch angle is between 55° and 68°.

5. The antenna system according to claim 1, wherein a difference between the first pitch angle and the second pitch angle is between 1° and 6°.

6. The antenna system according to claim 1, wherein the first pitch angle is greater than the second pitch angle.

7. The antenna system according to claim 1, wherein the pair of first elongated conductive legs comprising each of the first BHLs, and the pair of second elongated conductive legs comprising each of the second BHLs all occupy the same surface circumference around said common axis.

8. The antenna system according to claim 7, wherein the surface circumference is defined by a cylindrical dielectric form axially aligned with the common axis.

9. The antenna system according to claim 1, wherein the common feed structure is disposed in the feed plane that is arranged transverse to the common axis, and each pair of first elongated conductive legs comprising the first BHL extend a first distance in a predetermined direction along the common axis from the feed plane to a first terminal end plane.

10. The antenna system according to claim 9, wherein each said first BHL includes a transverse conductor portion which extends between each pair of first elongated conductive legs in the first terminal end plane.

11. The antenna system according to claim 10, wherein the transverse conductor portions from the first BHLs intersect in the first terminal end plane to form an electrical connection.

12. The antenna system according to claim 11, wherein each pair of second elongated conductive legs comprising each said second BHL extends in the predetermined direction a second distance along the common axis, to a second terminal end plane, the second distance less than the first distance.

13. The antenna system according to claim 12, wherein each said second BHL includes a transverse conductor portion which extends between each pair of second elongated conductive legs in the second terminal end plane.

14. The antenna system according to claim 13, wherein a first intersection point of the transverse conductor portions comprising each said first BHL is axially aligned on said common axis with a second intersection point of the transverse conductor portions comprising each said second BHL.

15. The antenna system according to claim 14, wherein the transverse conductor portions comprising each said second BHL are electrically isolated from each other at the second intersection point.

16. A method for providing a dual-band antenna system, comprising:

for radio frequency operations in a first frequency band using a first quadrifilar radiating element (QRE) comprising a plurality of first bifilar helical loops (BHLs) oriented in a mutual orthogonal relationship on a common axis, each first BHL comprising a pair of first elongated conductive legs, each said first elongated conductive leg defining a plurality of turns about said common axis at a first pitch angle, having a first turn radius, and electrically connected to closed circuit terminations;

for radio frequency operations in a second frequency band different from the first frequency band, using a second QRE which shares a common feed structure with the first QRE;

arranging the second QRE to include a plurality of second BHLs oriented in a mutual orthogonal relationship on the common axis, each second BHL comprising a pair of second elongated conductive legs, each said second elongated conductive leg defining a plurality of turns about the common axis at a second pitch angle, having a second turn radius and electrically connected to closed circuit terminations;

tuning a configuration of the first and second QRE so that the first radius is substantially equal to the second radius, whereby the elongated conductive legs comprising the first QRE can be disposed on a same cylindrical shell as the elongated conductive legs comprising the second QRE; and wherein the first pitch angle is different than the second pitch angle.

17. The method according to claim 16, wherein the first frequency band has a first frequency range including a first band upper frequency limit, the second frequency band has a second frequency range including a second band lower frequency limit, and wherein a percent difference between the second band lower frequency limit and the first band upper frequency limit is less than 15%.

18. The method according to claim 16, further comprising disposing the common feed structure in a feed plane transverse to the common axis, and extending each pair of first elongated conductive legs comprising the first BHL a first distance in a predetermined direction along the common axis from the feed plane to a first terminal end plane.

19. The method according to claim 18, further comprising including at the first terminal end plane a transverse conductor portion extending between corresponding pairs of the first elongated conductive legs which form each said first BHL.

20. The method according to claim 19, further comprising forming an electrical connection between the transverse conductor portions of the first BHLs where the transverse conductor portions intersect in the first terminal end plane.

21. The method according to claim 20, further comprising extending each pair of second elongated conductive legs comprising each said second BHL in the predetermined direction a second distance along the common axis, to a second terminal end plane, the second distance less than the first distance.

22. The method according to claim 21, further comprising including at the second terminal end plane second transverse conductor portions which extend between corresponding pairs of the second elongated conductive legs which comprise each said second BHL.

23. The method according to claim 22, further comprising preventing a discontinuity in antenna pattern associated with the second QRE by electrically isolating the second transverse conductor portions comprising each said second BHL.

* * * * *